US007614414B2

(12) United States Patent
Jamshidi

(10) Patent No.: US 7,614,414 B2
(45) Date of Patent: Nov. 10, 2009

(54) CONVERTIBLE CRUTCHES

(76) Inventor: Anahita Jamshidi, 1303 Cherokee Rd., Townville, SC (US) 29689

( * ) Notice: Subject to any disclaimer, the term of this patent is extended or adjusted under 35 U.S.C. 154(b) by 0 days.

(21) Appl. No.: 11/541,642

(22) Filed: Oct. 3, 2006

(65) Prior Publication Data

US 2007/0074748 A1 Apr. 5, 2007

Related U.S. Application Data

(60) Provisional application No. 60/722,452, filed on Oct. 3, 2005.

(51) Int. Cl.
*A61H 3/02* (2006.01)

(52) U.S. Cl. ..... 135/66; 135/74; 297/118; 248/155

(58) Field of Classification Search ..... 135/65–66, 135/68–69, 74; 297/118, 129; 248/155–155.5, 248/188.6

See application file for complete search history.

(56) References Cited

U.S. PATENT DOCUMENTS

| | | | | | |
|---|---|---|---|---|---|
| 751,942 | A * | 2/1904 | Renno | 135/68 |
| 1,463,675 | A * | 7/1923 | Coleman | 135/68 |
| 1,972,668 | A * | 9/1934 | Sheldon | 248/155.2 |
| 2,766,813 | A * | 10/1956 | Reuben | 297/54 |
| 3,537,748 | A * | 11/1970 | Knapp | 297/118 |
| 3,709,159 | A * | 1/1973 | Oglesby, Jr. | 108/44 |
| 4,910,927 | A * | 3/1990 | Beatty | 135/66 |
| 5,090,434 | A * | 2/1992 | Hagen | 135/66 |
| 5,185,892 | A * | 2/1993 | Mitchell | 4/578.1 |
| 5,735,303 | A * | 4/1998 | Cole | 135/66 |
| 5,746,236 | A * | 5/1998 | Tilsley et al. | 135/66 |
| 6,311,708 | B1 * | 11/2001 | Howle | 135/67 |
| 6,386,217 | B1 * | 5/2002 | Cooper et al. | 135/74 |

* cited by examiner

*Primary Examiner*—Winnie Yip
(74) *Attorney, Agent, or Firm*—Moazzam & Associates, LLC

(57) ABSTRACT

Devices and methods are presented to provide a seating area on a common crutch. The convertible seat is low profile and maintained flat on a side of the crutch until needed. It may be opened easily and placed flat on the floor to provide the user with a convenient sitting or table area.

13 Claims, 8 Drawing Sheets

CONVERTIBLE CRUTCHES

This application claims priority to U.S. Provisional Patent Application Ser. No. 60/722,452, filed Oct. 3, 2005, the content of which is hereby incorporated by reference in its entirety into this disclosure.

BACKGROUND OF THE INVENTION

1. Field of the Invention

The present invention relates to convertible crutches. More particularly, the present invention relates to crutches that have a movable arm that extends out to allow the user to rest on a chair formed by the arm and the crutch.

2. Background of the Invention

One of the oldest and most universally recognized devices still in use today in medical practices worldwide is the common crutch. Such common crutches are ubiquitous and essentially the same shape and design everywhere throughout the world. These common crutches are most often used by persons who have had an accident, have undergone a medical procedure usually involving the lower extremity, or otherwise have difficulty walking. A common use for the common crutch is to assist the person who has some immobility in maintaining balance and/or providing assistance during walking.

Although heavy and often cumbersome, the common crutch is usually constructed of wood or a lightweight metal, and remains a simple yet invaluable device that assists a mobility-compromised person in traveling or standing. However, such crutch cannot perform other functions that the person using it also would need, for example, provide an option to rest. A person using such a common crutch often gets tired from the awkward and unusual process of walking using such crutches and often needs to stop and rest, mostly by leaning against the crutch and using it as a base anchor or pole. Such rest has to be done standing up because there are typically no nearby chairs or benches for the person to rest upon. Resting on the ground/floor would not be a usual option because sometimes the process of getting up to a standing position from a sitting position on the ground/floor is sometimes more tiresome than the walking process using the crutches.

After an injury to the leg, be it a break, sprain, or surgery, the patient is often advised to keep weight off of the leg and walk with the aid of crutches until the injury can finish healing. From the 1994 National Health Interview Survey on Disability, Phase I, in 1994, 575,000 people in the United States found themselves on crutches. If the numbers for people using canes and walkers is included, the number jumps to 7,136,000 people.

When a person finds themselves on crutches, her personal and worldviews change. Balance is affected, nimbleness is reduced, more space is required for locomotion (48" in a passageway versus 24" for a healthy human being), and more/new stress is placed on the non-injured leg, wrists, and underarms. Distances previously covered on foot without difficulty become a challenge, and many more rest periods are needed. Activities that previously did not require much effort, such as running errands, shopping in the mall or at the grocery store, spending time in line at the post office or department of motor vehicles now become major chores. Something as minor as standing around can become an exhaustive activity. Taking the stairs up to one's non-ADA (Americans with Disabilities Act) approved domicile can cause mental as well as physical stress. Joints not used to such extensive use are at risk for repetitive stress injury (RSI). Over time, the muscles pulled in to compensate for the damaged leg will strengthen and be better able to withstand the extra load placed upon them. Meanwhile, and even later, sometimes all that is needed is the ability to give the overworked muscles and joints a brief rest. However it is rare to nonexistent to see a chair in the middle of a crowded clothes store, there is no seating available as one waits in the security line at the airport, chairs are not built into sidewalks every 20 feet, or even 20 yards, and even a museum, which has seating, does not have so much that it is available when and where one may need it. People with mobility assist devices, such as crutches, feel this lack of available seating and resting areas much more than the rest of the population, which does not even have the additional burden of having to carry those cumbersome crutches.

Thus, there is a need in the art for a simple and universal technique to provide a way for persons using crutches to rest anywhere, any time, without having to look for appropriate places to rest, such as a chair or bench, and without the need to have to sit on the ground or floor.

SUMMARY OF THE INVENTION

The present invention provides a simple and cost effective technique as an add-on of or inherent component to a common crutch and includes a convertible mechanism that folds out from the crutch to become a chair. Thus, the present invention provides for a need in the art for a simple and universal technique to provide a way for persons using crutches to rest. The technique uses a design that is unobtrusive, lightweight, opens and closes quickly with minimum force, fits the size demographic, and provides a chair, any time, any place.

This invention is applicable and useful for a wide variety of potential users, not just for injured or temporarily immobile persons. One example target group includes pregnant women. This group carries around, without respite, a fetus for nine months. Lower back as well as other body pain is common, and the opportunity to rest whenever there is a chance wherever there is such need would be an ideal advantage. Even after giving birth, although strollers and other devices exist for carrying their child, the use of this invention may extend through the early years of the child's life.

No matter who the ultimate user of the present invention will be, certain characteristics of all such users are universal. For example, a person using common crutches typically needs or desires many rest periods to traverse a distance that normally would take the person a relatively shorter period of time. The distances between available seating may not be close enough to get from one area to the next without needing a break in between. Often, such a person on crutches traversing between distances wishes that appropriate seating was immediately available whenever the person gets tired during a walk to take a brief break before continuing on the way. Even standing in one place to rest is typically painful because the person still has to balance on the one leg that does most of the work during such a crutch "walk" and isn't receiving any respite.

Thus, the users of the present invention include a vast market, from pregnant women and new mothers to people placed on crutches temporarily or permanently due to acute injuries, surgery, amputation, age, weakness or congenital or birth defects.

One of the many advantages of the present invention is that it is designed to be perfectly attachable to the common crutch. Alternatively, an exemplary embodiment of the present invention includes a crutch with an attached chair component already installed thereon. In either scenario, through the use of crutches already available, a lightweight portable seating arrangement is made available and attached to the crutches already in use that allows the user to rest for periods of time any time, anywhere where no other seating is available.

In one exemplary embodiment, the present invention is a device for providing rest. The device includes a first set of arms attachable to a crutch, the first set of arms moveable with respect to the crutch; and a second set of arms attached to the first set of arms; wherein the first set of arms and the second set of arms can be positioned so that the first set of arms is perpendicular to a vertical standing crutch and the second set of arms is substantially parallel or at an angle to the vertical standing crutch so as to form a sitting platform In another exemplary embodiment, the present invention is a crutch for assistance in mobility. The crutch includes a set of parallel arms in connection with each other at one end with a perpendicular connecting top piece and at the other end through a central vertical piece; a first set of arms attachable to the parallel arms, the first set of arms moveable with respect to the parallel arms; and a second set of arms attached to the first set of arms; wherein the first set of arms and the second set of arms can be positioned so that the first set of arms are perpendicular to the set of parallel arms and the second set of arms are substantially parallel or at an angle to the set of parallel arms so as to form a sitting platform.

In yet another exemplary embodiment, the present invention is a method for converting a crutch into a chair. The method includes unfolding a first set of arms from the crutch; unfolding a second set of arms from the first set so as to place the second set of arms on the floor; and placing the crutch vertically on a floor such that the sets of arms form a supported platform for sitting.

In addition to these embodiments, the invention can also encompass a table alongside or in place of the chair. When incorporated alongside the chair, a surface made of a suitable material can be extended out from the crutch in a similar fashion as the chair. This surface can be placed alongside the chair, is secured by a set of arms that connect either to the crutch itself or rest on the floor. This allows the crutch to be converted to a combination chair and desk and/or other useful surface.

DETAILED DESCRIPTION OF THE INVENTION

The present invention provides systems and methods for addressing challenges faced by persons using the common crutch. One of main setbacks of the common crutch, which aims to assist the user in mobility, is the cumbersome and tiring process involved in using such a crutch during motion. In essence, the same crutches that assist in providing mobility also induce fatigue because of the very nature of their design. Thus, persons using the common crutch are often tired from having to use the crutch, and with potentially one or more legs also being injured, the need to stop, sit, and rest cannot be more emphasized.

The present invention provides the user with an option to sit and rest on one of the very crutches that the person has been using. The design is simple to use and steady and sturdy enough to accommodate most crutch users. The user can stop anywhere, any time and sit on the very crutch that is assisting them in mobility. A method is provided to convert a crutch into a surface that can be used as a chair with backrest, a table, and any combination of the two. The purpose is to combine these features into one lightweight and user-friendly device. These and other uses and advantages are inherent in the design of the present invention and within the scope of the present application. Other uses and advantages not specifically described herein are still within the scope of the present invention and the purview of one having ordinary skill in the art.

Figure 1A:
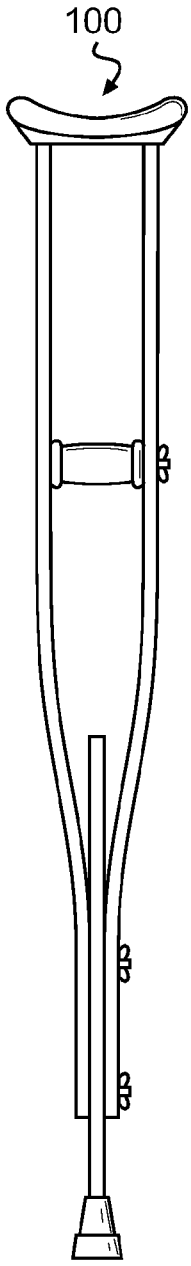
FIG. 1B shows a perspective view of a crutch with a convertible arm in an extended chair position according to an exemplary embodiment of the present invention shown alongside a conventional crutch (FIG. 1A).
Figure 1B:
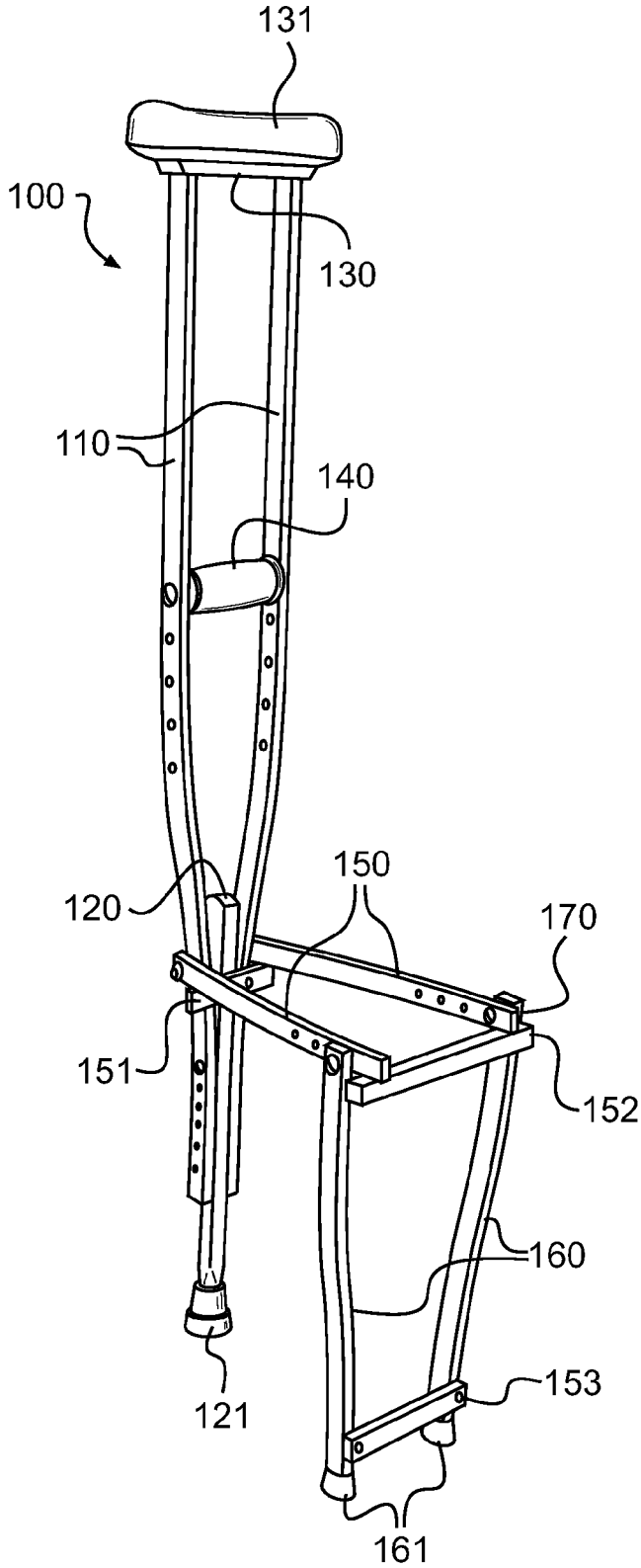

As shown in FIGS. 1 and 2, a convertible crutch is presented alongside a conventional crutch in order to show the present invention as either an add-on feature to existing crutches or as a stand-alone pre-fabricated crutch with the convertible chair made available thereon. In other words, a conventional crutch body 100 may be used as a platform for the convertible chair that can be easily added on. Optionally, a crutch 100 may be manufactured pre-formed with a convertible chair available thereon.

The average common crutch 100 has two vertical pieces 110 connected with several cross pieces, including a top horizontal piece 130 and a horizontal middle piece 140, typically lined with a cushioning material that serves as a hand grip. A vertical center piece 120 serves to attach the bottom ends of the two vertical pieces 110 using standard attaching devices, such as nuts and bolts or equivalent fastening mechanisms. At the bottom end of the vertical center piece 120 is a cushioned stopper 121 that allows for a secure and non-slippery grip on the floor/ground during movement. Top horizontal piece 130 is typically designed to fit under the arm of a user. A padded underarm surface 131 may be positioned atop the top horizontal piece to make it more comfortable for the user during movement.

An exemplary embodiment of the present invention shows a convertible chair portion that is attachable to the crutch frame 100 using standard attaching devices, including, but not limited to, nuts, bolts, screws, nails, ratchets, snap fit pieces, and equivalents. The chair portion is designed to have a low profile so as to minimize the size and weight of the crutch 100 containing such chair portion. Also, the low profile shape allows the chair portion to neatly fold within the framework of the crutch 100, as shown in FIGS. 2 and 3. The low profile also makes the crutch 100 easier to use during normal walking by the user.

The chair portion has two horizontal portions 150 that form the framework of the sitting area. The two horizontal portions 150 are attached to the vertical leg portions 160 using appropriate securing devices, as described above. A stabilizing knee bar 152 extends from one side to the other side of each of the 150-160 junctions. The stabilizing knee bar 152 maintains the proper and constant distance between the 150-160 junctions and provides a stable sitting surface and geometry. An additional stabilizing ankle bar 153 provides a similar function as the stabilizing knee bar 152 and is positioned at the lower ends of the two vertical leg portions 160. One of the purposes of the stabilizing knee bar 152 is to prevent the over-extension of the two vertical leg portions 160 with respect to the two top horizontal portions 150. In essence, the stabilizing knee bar 152 provides a maximum angle of 90° at the joint portion of the top horizontal portions 150 and two vertical leg portions 160. At the ends of the vertical leg portions 160 are cushioned stoppers 161, similar to that at the bottom portion of vertical center piece 120, and which serve to provide stability and grip on the floor/ground while the chair portion 200 is opened up and the person is resting thereon. Thus the three cushioned stoppers 121, 161, and 161 serve as the three points of contact with the floor/ground of the chair portion of a crutch 100.

Optionally, a rear stabilization bar 151 is positioned perpendicular to the vertical pieces 110 and center piece 120. This serves to provide a maximum opening angle of 90° at the joint comprising portions 150 and the vertical pieces 110. The stabilizing bars 151 and 152 both serve the same function of providing maximum angles for the chair portion joints so as to minimize any collapse of the chair portion while a person is sitting thereon. Optionally, a flat surface may be inserted in the frame formed by portions 150 and 152, with grooves to accommodate the vertical pieces 110. This flat surface may take the form of a cushion to provide a comfortable sitting area for the user of the convertible crutch.

Also, one or more reversibly locking latches 170 may be included on the crutch 100 to fasten and maintain the chair portion in a folded position against the side of the crutch when not in use, as shown in FIGS. 2 and 3. These latches 170 may be positioned to engage with the stabilizing bars 152 or 153, and/or the vertical leg portions 160. Use of such latches 170 or other equivalent securing mechanism (e.g., hook, knob, bendable metal, etc.) also prevents the accidental opening of the chair portion when it is not so desired. Other mechanical securing mechanisms include using magnets, snap-fit, a pulley, or a spring. Equivalent methods not specifically provided for in this application are still within the scope of the present invention and the purview of one having ordinary skill in the art.

As is commonly the case, the size of the crutch 100 is largely dependent on the size (height, weight, body mass) of the user. Thus, the chair portions are designed such that the vertical and horizontal portions 160 and 150 are of sufficient length to accommodate the person that will be using that size crutch. The length of the vertical and horizontal leg portions 160 and 150 can be adjustable, perhaps telescopically, to accommodate different heights. See FIGS. 5A and 5B.

Figure 2A:
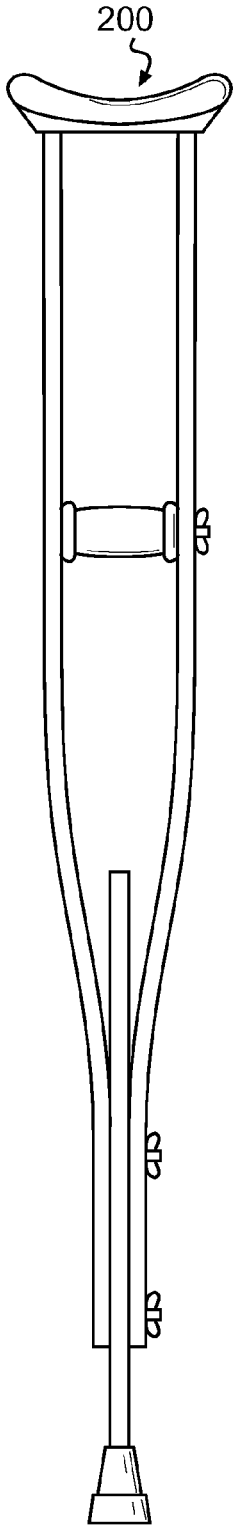
FIG. 2B shows a side view of an exemplary embodiment of the present invention in an (folded) un-extended crutch position shown alongside a conventional crutch (FIG. 2A).
FIG. 2C shows a front view of an exemplary embodiment of the present invention in an un-extended crutch position.
Figure 2B:
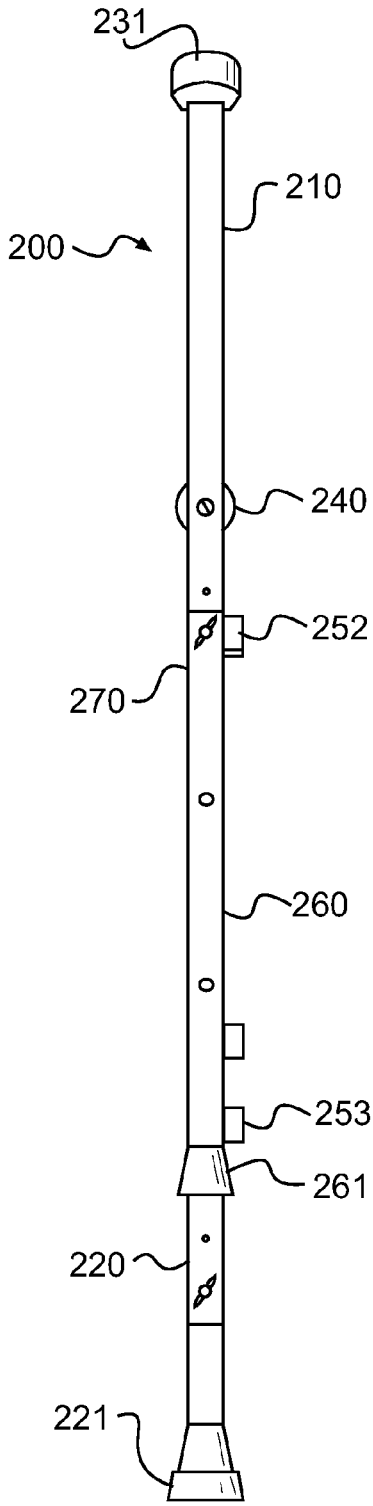
Figure 2C:
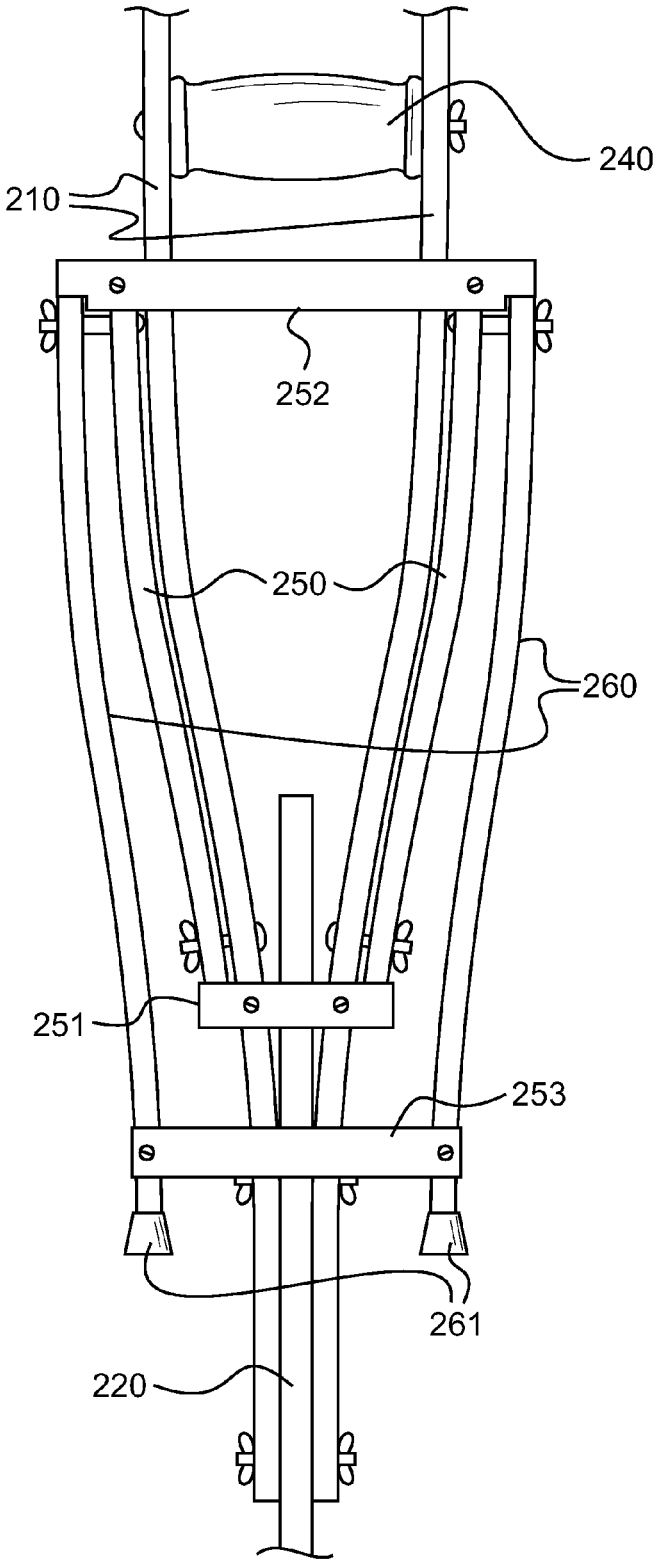

FIGS. 2B and 2C show different views of one embodiment of the convertible crutch when folded. FIG. 2B shows a side profile of a fully closed convertible crutch alongside a common crutch 200 (FIG. 2A). As in FIG. 1, the two vertical pieces 210 connected with several cross pieces, including a top horizontal piece with a cushioned surface 231 and a horizontal middle piece 240. The vertical center piece 220 serves to attach the bottom ends of the two vertical pieces 210 and includes a cushioned stopper 221. More importantly, the arms 250 that form the sitting surface are invisible in FIG. 2B, as they are hidden within the vertical arms 260, which form the $2^{nd}$ and $3^{rd}$ supporting arms for the chair. These arms 250 are visible in the close-up of the chair portion shown in FIG. 2C, which also provides a clearer view of the vertical center piece 220. The stabilizing knee and ankle bars 252 and 253 are also flush with the profile of the convertible crutch. This mechanism allows for a slim profile that does not impede the use of the crutch for standing or walking.

Figure 3A:
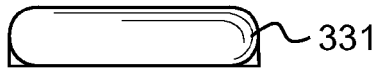
FIGS. 3A, 3B and 3C show top, front and side views of a convertible crutch in an un-extended crutch position according to an exemplary embodiment of the present invention.
Figure 3B:
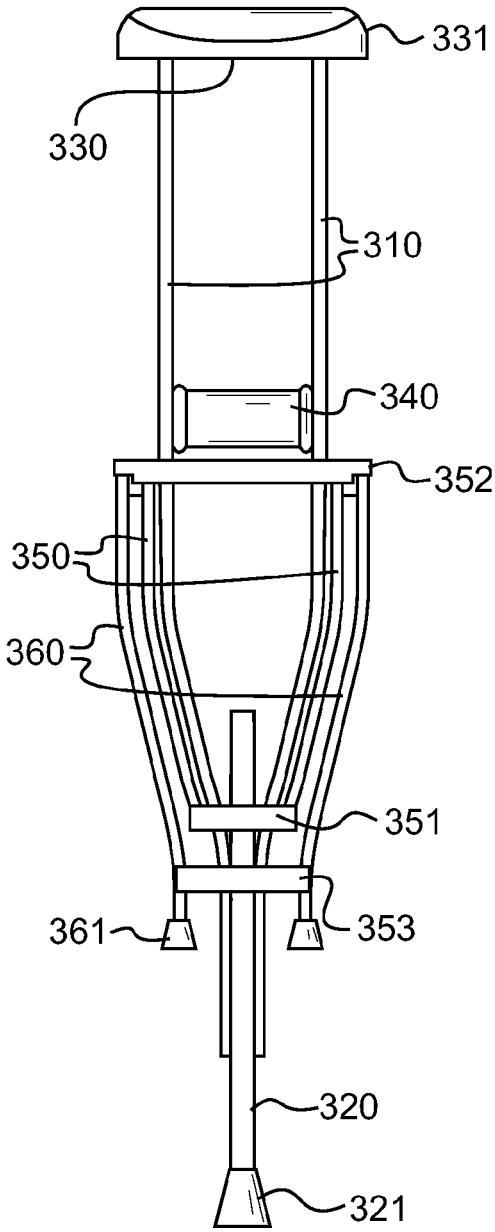
Figure 3C:
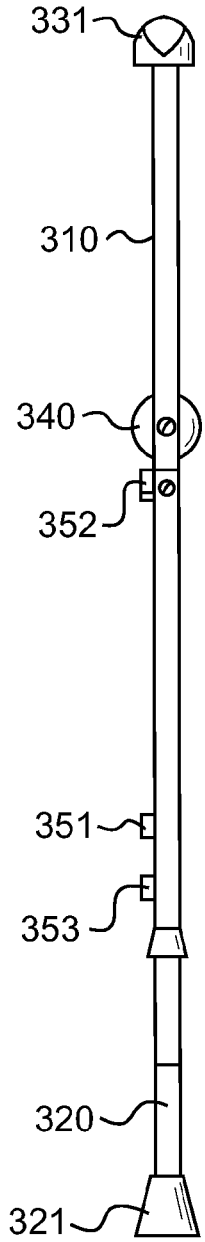

FIGS. 3A, 3B, and 3C show different views of another exemplary embodiment of the present invention as a crutch when folded. As in FIGS. 1 and 2, the two vertical pieces 310 connect with cross pieces 330 and 340, 330 having a padded cushion 331, and 340 having padding for improved grip. Vertical center piece 320 also connects the two vertical pieces 310 and includes a cushioned stopper 321. The arms 350 that form the sitting surface fit flush within vertical arms 360 when closed, as do the stabilizing knee bars 352 and 353.

Figure 4A:
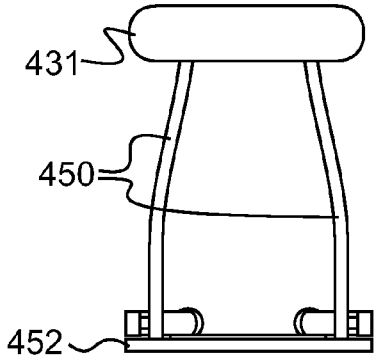
FIGS. 4A, 4B and 4C show top, front and side view of a convertible crutch in an extended chair position according to an exemplary embodiment of the present invention.
Figure 4B:
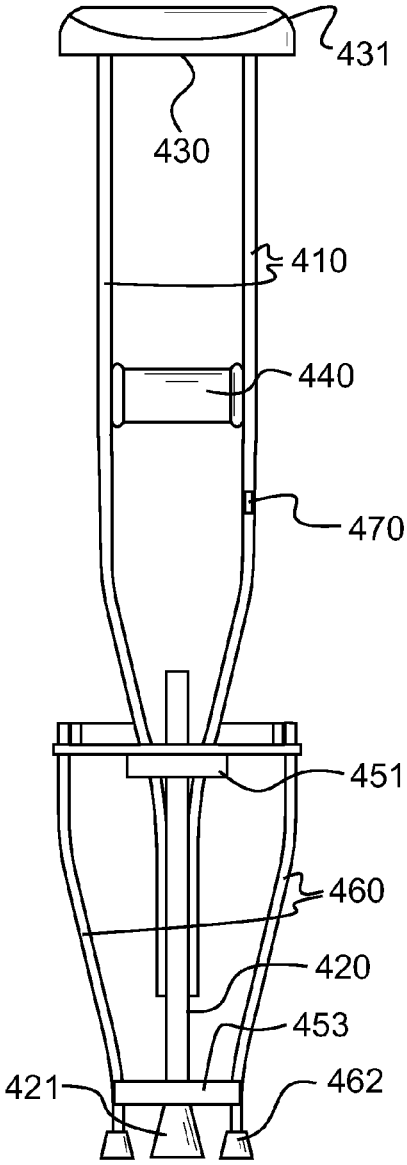
Figure 4C:
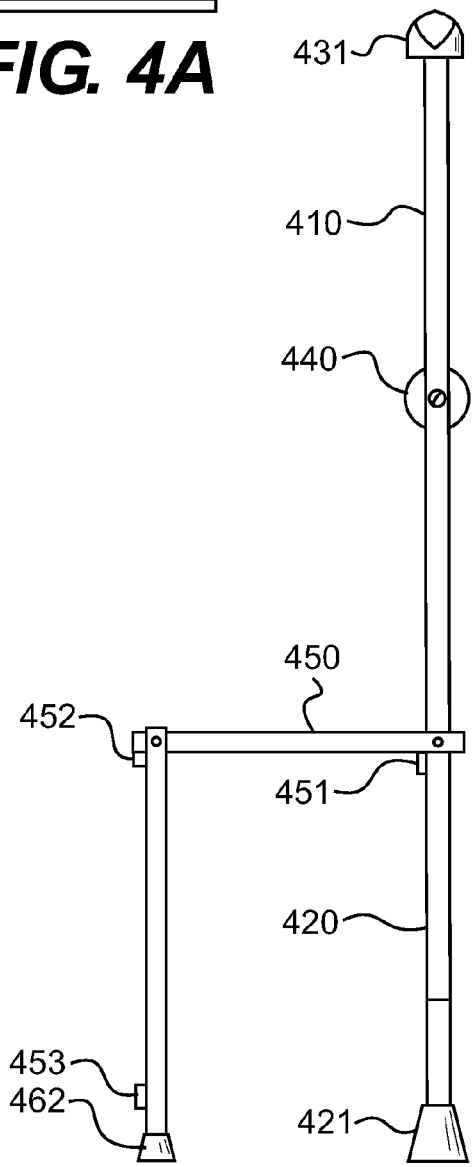

FIGS. 4A, 4B, and 4C show an exemplary embodiment of a crutch according to the present invention when opened and converted to a chair. Two vertical pieces 410 are connected with horizontal cross pieces 430 and 440 (also lined with a cushioning material). Vertical center piece 420 connects vertical pieces 410 and has a cushioned stopper 421. Two horizontal portions 450 form the framework of the sitting area and are secured to vertical portions 460 using appropriate securing devices, as described above. Stabilizing bar 451, knee bar 452, and ankle bar 453 limit the extension angle and provide symmetry and stability. Cushioned stoppers 462 provide stability and grip when opened.

Figure 5A:
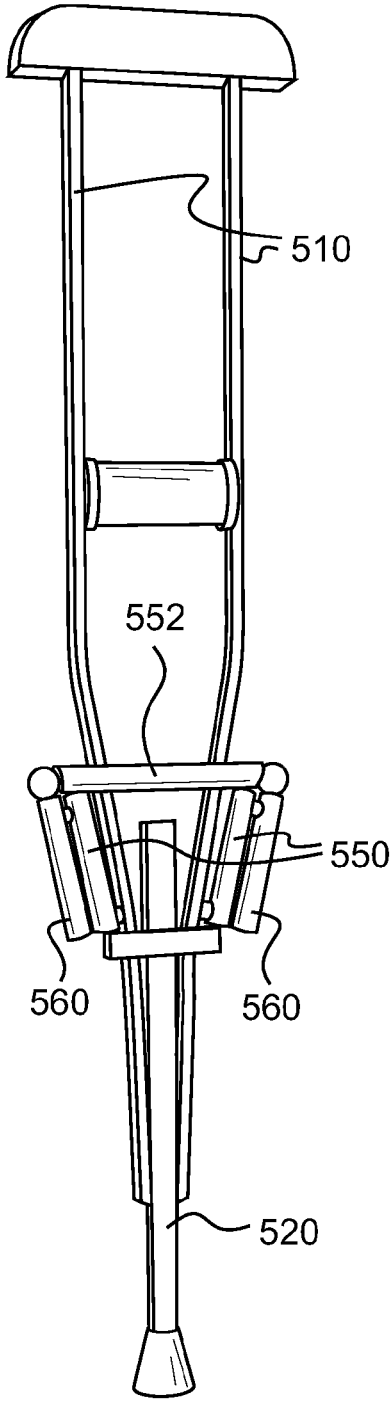
FIGS. 5A and 5B show a convertible crutch with telescoping arms, in closed and open positions, respectively, according to an embodiment of the present invention.
Figure 5B:
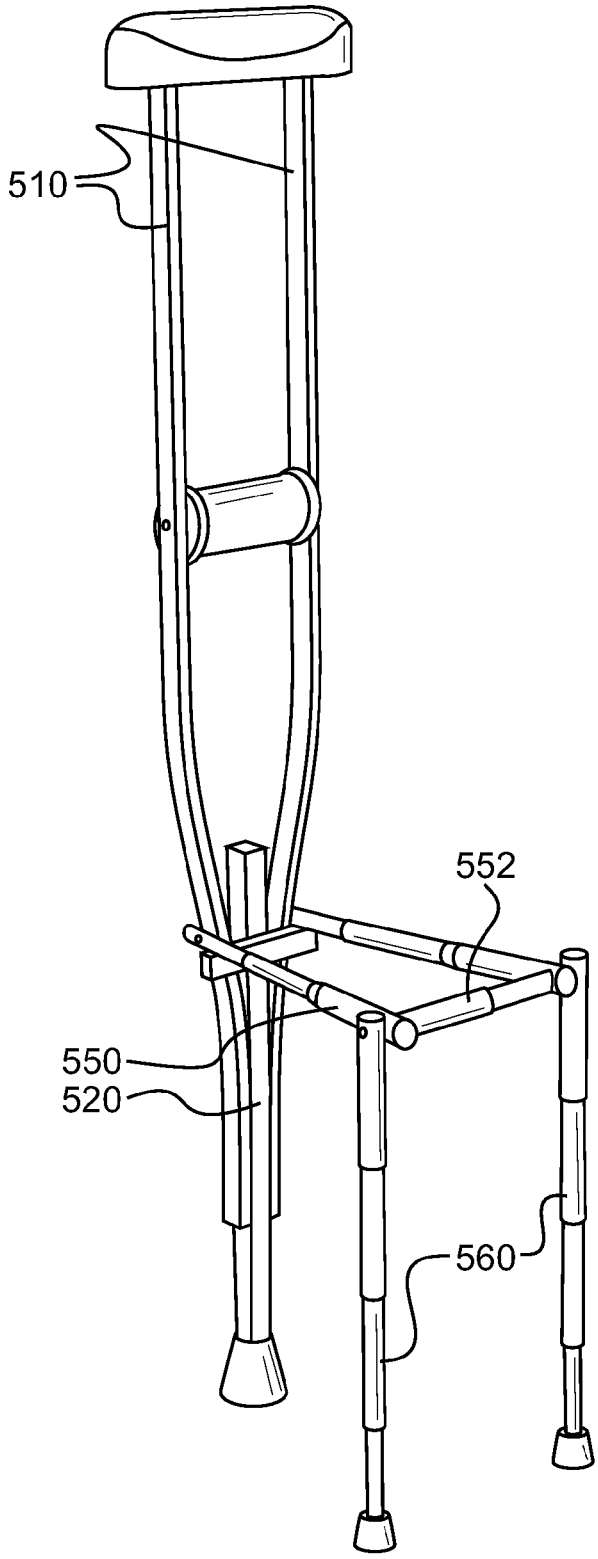

As discussed above, there is a provision for users of different sizes, and this involves length-adjustable arms as shown in FIGS. 5A and 5B. The convertible crutch remains essentially the same, except for a few structural differences. Horizontal portions 550, and vertical portions 560 are now length-adjustable using a telescoping mechanism. Also, cross bar 552 automatically adjusts with the length of 550, to allow for sitting surfaces of various lengths and widths. This provision allows a user to customize the height and size of the chair surface to meet his or her needs.

Figure 6:
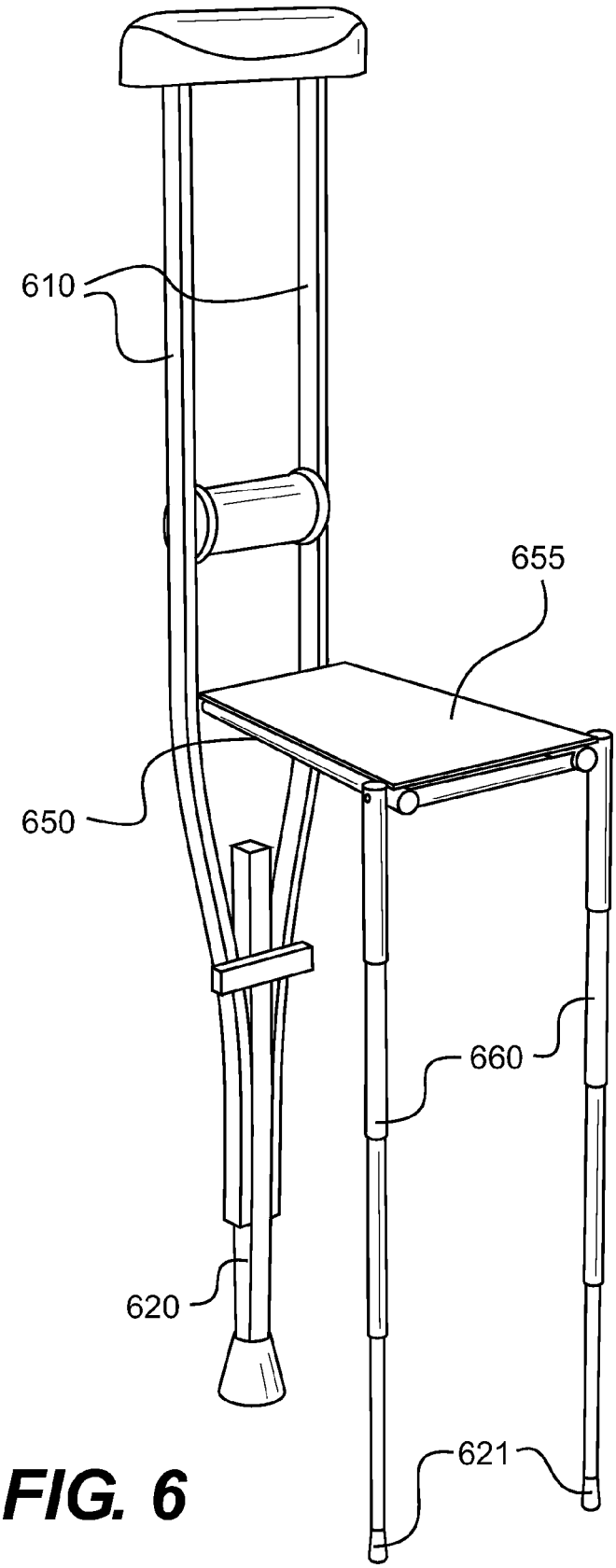
FIG. 6 shows a convertible crutch opened as a table with telescoping arms according to an exemplary embodiment of the present invention.
Figure 7:
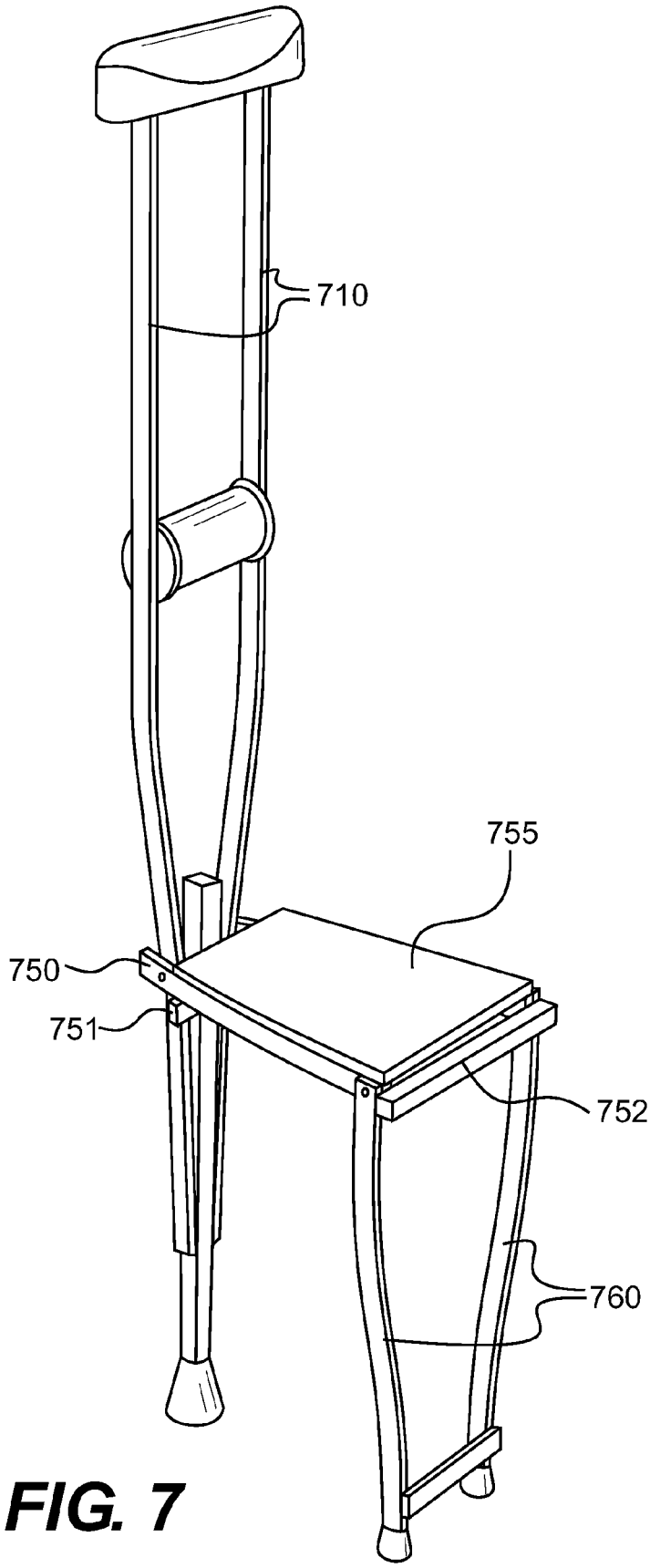
FIG. 7 shows a convertible crutch in an extended chair position having a seat cushion surface, according to an exemplary embodiment of the present invention.

Another option is a seat cushion surface to rest on top of the horizontal portions 150 as shown in FIG. 7. This surface 755 is attached to a rigid bottom portion hinged on one horizontal portion 750 and latched on the other. When unfolded, the cushion is unlatched allowing it to swing upward. The crutch chair is then folded in the fashion described above. Once folded, the cushion may swing back into position and latched thereby holding the chair portion securely in position. This concept is further extended to using the surface as a table, as shown in FIG. 6. The telescoping arm members 660 allow for height adjustment, while the surface 655 that is set between horizontal arms 650 can be used as a table as opposed to a chair.

Many other optional features that are not shown are capable of being provided on the crutch 100 in addition to the convertible chair. Potential add-ons to the chair would be a container to hold small items, or larger ones, such as a grocery bag. These add-ons can be detachable or permanent. They can be rigid shapes to hold specific items such as laptops, bottles, umbrellas, etc., or they can be amorphous and expandable to store items such as documents, electronics, shopping, etc. Construction materials include netting, fabric, polymers, and equivalents. Some examples include mobile phone holders, laptop compartments, pen holders, file folders, etc. Attachment methods include but are not limited to hooks, hook and loops, magnets, clasps, snaps, or screw-ons, and equivalents thereof. Larger add-ons or those hanging low on the crutch can be stabilized by using additional clasps, for instance one on top and one on the bottom. In addition, Velcro straps or belt buckles can be used to secure these add-ons to prevent excessive swaying or swinging while the user is traveling.

The additional weight of such a device may require a counterbalance of some sort on the other crutch. This can be achieved through a portable table designed like the seat, but placed on the opposite crutch. In this scenario, the seat would be designed for longer rest periods, and the crutch user would not need to look for other seating. As long as they have their crutches with them, they would have at their constant disposal a chair and desk adjusted to their personal measurements at which to work. Thus, the addition of the chair portion or a similar device thereof to the other crutch may make the standard crutches 100 be convertible to an instant chair and table. The table, or any equivalent surface, can be raised and lowered using a mechanism similar to that of the chair. In one embodiment, the surface comprises one or more surfaces that can be extended from either one side of the crutch, or both sides and meeting and securing in the middle. This includes folding surfaces, or a unidirectionally rigid material that can be rolled up and latched in place like window blinds. Alternatively, the surface can be permanently extended, whether in the open or closed position. Depending on the material used, the mechanisms for securing the surface could include latches, magnets, electromagnets, snap-fit, hook and loop, and equivalent securing mechanisms similar to those of the chair. The surface could also be held in place by a belt buckle mechanism, or a button-snap attached to a length of some flexible material. Ideally, the surface would have a slim profile and be constructed of some light material to minimize weight of the crutch and to avoid impeding usage of the crutch while standing or walking. Construction materials could include wood, metal, plastic, netting, fabric, and equivalents and combinations thereof.

The latching and unlatching of the chair portion can be electronically monitored and controlled. A user has the option of pushing a button to activate the folding/unfolding mechanism. A pulley-based mechanism would be operated by a motor controlled by a microprocessor. A hydraulic or magnetic securing mechanism could be controlled by a circuit that controls the magnet or the amount of pressure in the pistons. Alternatively, the user may use voice commands to control the process. Equivalent methods not specifically provided for in this application are still within the scope of the present invention and the purview of one having ordinary skill in the art.

The entire chair portion or parts thereof may be constructed of a lightweight wood, metal, plastic, composite or similar material to minimize any addition in weight. The arms and other members comprise cross-sections that may or may not be rectilinear, and include circular, oval, crescent, and triangular cross-sections.

Such idea as shown as the convertible chair is also applicable to other walking assist devices, such as walkers, canes and strollers.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. For example, the shape and size of the chair portion may be made differently and still be within the scope of the present application. Also, the method of extending the chair from the crutch does not have to be through rotating arms, but can include other techniques such as, for example, locking telescoping arms. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device for providing rest, the device comprising:

a single vertical standing crutch having two longer elongated vertical members coupled to each other with an arm-resting top piece, and a shorter elongated member positioned therebetween, the shorter elongated member having a bottom end which contacts the ground when the crutch is held vertical;

a first set of elongated arms having a first end and a second end, the first end of each arm pivotally attached directly to a corresponding one of the two longer elongated vertical members of the crutch at a fixed vertical position rotatable joint; and a second set of elongated arms having a first end and a second end, the first end of the second set of elongated arms pivotally attached directly to the second end of the first set of arms at a rotatable joint and each second set elongated arm having a distal end which independently contacts the ground;

wherein the first and second sets of elongated arms are foldable so as to lay substantially flat against the crutch;

wherein to create a stable sitting position, a combination of the first set of elongated arms and the second set of elongated arms is connected to the crutch at only the first end of the first set of elongated arms; and wherein in a stable sitting position, the first set of elongated arms and the second set of elongated arms are positioned so that the first set of elongated arms is perpendicular to the vertical standing crutch and the second set of elongated arms is substantially parallel to the vertical standing crutch such that the bottom end of the shorter elongated member and the two distal ends of the second set of elongated arms all contact the ground at three distinct points allowing a crutch to stand stably and vertically upon the ground and providing a sitting platform which is parallel to the ground.

2. The device of claim 1, wherein the length of the second set of elongated arms is adjustable.

3. The device of claim 1, wherein lengths of the first and second sets of elongated arms are telescopically adjustable.

4. The device of claim 1, wherein the first and second sets of elongated arms are lockable in a folded position.

5. The device of claim 1, further comprising a stabilizing bar positioned across the second set of elongated arms to maintain the relative position between the first and second sets of arms.

6. The device of claim 5, wherein a flat surface rests between the first set of elongated arms perpendicular to the crutch and the stabilizing bar.

7. The device of claim 1, wherein the second set of elongated arms telescopically extend out from the first set of elongated arms.

8. A crutch for assistance in mobility, the crutch comprising:

a set of vertical members in connection with each other at one end with a perpendicular connecting arm-resting top piece and at the other end through a central vertical piece having a bottom portion which contacts the ground at a single point;

a first set of elongated arms having a first end and a second end, the first end of each elongated arm pivotally attached directly to a corresponding one of the vertical members at a fixed vertical position rotatable joint; and a second set of elongated arms having a first end and a second end, the first end of each second elongated arm pivotally attached directly to the second end of each of the first set of arms at a rotatable joint, the second set of elongated arms moveable with respect to the first set of elongated arms and the second set of elongated arms having distal ends which contact the ground at two distinct points;

wherein the first and second sets of arms are foldable so as to lay substantially flat against the vertical members;

wherein to create a stable sitting position, a combination of the first set of elongated arms and the second set of elongated arms is connected to the vertical members at only the first end of the first set of elongated arms; and wherein in a stable sitting position, the first set of elongated arms and the second set of elongated arms are positioned with the bottom portion of the central vertical piece and the two distal ends of the second set of elongated arms contacting the ground at three distinct points so that the first set of elongated arms are perpendicular to the set of vertical members and the second set of elongated arms are substantially parallel to the set of vertical members so as to form a sitting platform which is parallel to the ground and provides a stable and sturdy surface for sitting by an adult.

9. The crutch of claim 8, wherein the length of the second set of elongated arms is adjustable.

10. The crutch of claim 8, wherein the first and second sets of elongated arms are lockable in the foldable position.

11. The crutch of claim 8, further comprising a stabilizing bar positioned across the second set of elongated arms to maintain the relative position between the first and second sets of elongated arms.

12. The crutch of claim 11, wherein a flat surface rests between the first set of elongated arms perpendicular to the vertical members and the stabilizing bar.

13. A method of converting a crutch according to claim 8 into a stable, vertical, stand-alone chair, the method comprising:

unfolding the first set of elongated arms from the vertical members;

unfolding the second set of elongated arms from the first set of elongated arms contacting the distal ends of the second set of elongated arms with the ground such that the bottom portion of the central vertical piece and the distal ends of the second set of elongated arms contact the ground at three distinct points; and placing the crutch vertically on a floor such that the first and second sets of arms form a support platform for sitting which is parallel to the ground.

* * * * *